US008833016B2

(12) United States Patent
Reifer

(10) Patent No.: US 8,833,016 B2
(45) Date of Patent: Sep. 16, 2014

(54) FACADE SYSTEM WITH LESS VISIBLE SUPPORTS

(71) Applicant: FRENER & REIFER METALLBAU GmbH/Srl, Brixen/Bressanone (IT)

(72) Inventor: Franz Reifer, Vahrn (IT)

(73) Assignee: Frener & Reifer GmbH/SRL, Brixen (BZ) (IT)

( * ) Notice: Subject to any disclaimer, the term of this patent is extended or adjusted under 35 U.S.C. 154(b) by 0 days.

(21) Appl. No.: 13/785,925

(22) Filed: Mar. 5, 2013

(65) Prior Publication Data

US 2013/0180189 A1 Jul. 18, 2013

Related U.S. Application Data

(63) Continuation-in-part of application No. 13/353,206, filed on Jan. 18, 2012, now abandoned, which is a continuation-in-part of application No. 29/351,076, filed on Nov. 30, 2009, now abandoned.

(51) Int. Cl.
*E04B 2/96* (2006.01)
*E06B 3/67* (2006.01)

(52) U.S. Cl.
CPC ..... *E04B 2/967* (2013.01); *E04B 2/965* (2013.01); *E06B 3/6715* (2013.01)
USPC ..... 52/235

(58) Field of Classification Search
USPC ..... 52/235, 234, 236.3
See application file for complete search history.

(56) References Cited

U.S. PATENT DOCUMENTS

| | | | | |
|---|---|---|---|---|
| 4,236,362 | A | 12/1980 | Omholt | |
| 4,638,613 | A | 1/1987 | Tonsmann | |
| 5,381,637 | A * | 1/1995 | Farag | 52/204.595 |
| 5,481,839 | A * | 1/1996 | Lang et al. | 52/235 |
| 5,771,640 | A | 6/1998 | Back | |
| 5,918,437 | A | 7/1999 | Dobija | |
| D414,563 | S | 9/1999 | Dobija | |
| 6,016,632 | A | 1/2000 | McGee et al. | |
| 6,155,014 | A | 12/2000 | Wagner | |
| 6,170,211 | B1 | 1/2001 | Boyce | |
| 7,036,280 | B2 | 5/2006 | Hogan | |
| 2003/0226324 | A1 * | 12/2003 | Hogan | 52/235 |
| 2006/0080917 | A1 | 4/2006 | Hall et al. | |
| 2006/0201084 | A1 * | 9/2006 | Arias | 52/235 |

* cited by examiner

*Primary Examiner* — William Gilbert
*Assistant Examiner* — Kyle Walraed-Sullivan
(74) *Attorney, Agent, or Firm* — Browdy and Neimark, PLLC

(57) ABSTRACT

A façade system for buildings provides supports for glass having less surface area, whereby a more undisturbed view to the outside is provided. The equipping is conducted by fastening the used insulating transparent pane units in two steps. The weight of the used glass pane elements is supported by bearings that may be arranged at any position of at least one substantially horizontal or substantially vertical structure element. Due to their substantially horizontal or vertical alignment the bearings do not influence the size of the visible portion of the faced structure. To keep the panes tight on the building, pressure structure elements are mounted from the outside of the building to fasten the panes tight on the building structure or a carrying element of the building.

7 Claims, 5 Drawing Sheets

FACADE SYSTEM WITH LESS VISIBLE SUPPORTS

This is a Continuation-in-Part of co-pending application Ser. No. 13/353,206 filed Jan. 18, 2012, which is a Continuation-in-Part of design application No. 29/351,076, filed Nov. 30, 2009, the contents of each of which are incorporated herein by reference.

FIELD OF THE INVENTION

The present invention relates to a façade system with less visible supports. More particularly, the present invention relates to a façade system with less visible supports for buildings with glass facades to provide a human being an almost undisturbed view on the outside.

BACKGROUND OF THE INVENTION

Façade systems are used for construction of buildings with glass facades or extensive panes. Examples are shopping windows, buildings with glass frontage, conservatories, and the like. In general, façade systems have a supporting structure with elements in vertical and horizontal alignment.

Presently, a system that is already known for one skilled in the art is shown in FIG. 1, for example. Here, the panes are hold by vertical and horizontal rails. FIG. 1 clearly shows how the inner rail elements 20 and 21 of the shown façade system with a predetermined height $h_4$ clearly exceed the height $h_3$ of an outer structure element. As a result, a person standing inside the building of FIG. 1 has a view on the outside that is limited by the rail elements 20 and 21.

OBJECTS OF THE INVENTION

Accordingly, the objective of the present invention is to provide a façade system with less visible supports for buildings with glass facades to provide a human being an undisturbed view to the outside. This does not only make a human being inside the building feel better and freer but also enables a lot of new designs and interior decoration effects.

SUMMARY OF THE INVENTION

The present invention relates to a façade system with less visible supports. More particularly, the present invention relates to a façade system with less visible supports for buildings with glass facades to provide a human being an almost undisturbed view on the outside. Beside residences and office buildings with glass frontage, conservatories, swimming pools with landside view, shopping windows and restaurants may be equipped with the inventive façade system. The equipping is conducted by fastening the used insulating transparent pane units in two steps. The weight of the used glass pane elements is supported by bearings, preferably, flat bearings may be arranged at any position of at least one substantially horizontal or substantially vertical structure element. Due to their substantially horizontal or vertical alignment the bearings do not influence the size of the visible portion of the faced structure. To keep the panes tight on the building, pressure structure elements are mounted from the outside of the building to fasten the panes tight on the building structure or a carrying element of the building, preferably through the flat bearings.

In detail, the provided façade system with less visible supports as disclosed in the present invention comprises at least one substantially horizontal or substantially vertical structure element having a height $h_1$, an inner sealing element mounted on the horizontal structure element, an insulating transparent pane unit that may comprise at least one insulating glass pane, a pressure structure element for pressing the at least one glass pane in the general direction of the at least one substantially horizontal or substantially vertical structure element, wherein the pressure structure element has a height $h_2$, and an outer sealing element mounted on the pressure structure element. Further, the present invention is characterized in that the height $h_2$ of the pressure structure element has maximum that is equal to or less than the height $h_1$ of the at least one substantially horizontal or substantially vertical structure element to minimize the limiting of the view. Preferably, the height $h_2$ of the at least one substantially horizontal or substantially vertical structure element is equal to or less than 34 mm (1.34 inches). Alternatively, the height $h_2$ of the pressure structure element has a maximum of not more than the height $h_1$ of the at least one substantially horizontal or substantially vertical structure element plus 32 mm (1.26 inches) to minimize the limiting of the view.

The façade system further comprises a bearing structure mounted on the at least one substantially horizontal or substantially vertical structure element to bear the weight of the at least one glass pane. For the sake of completeness, it should be noted that the glass panes are similarly mounted on the vertical structure elements and vertical pressure structure elements.

The invented façade system with less visible supports further comprises a groove in the pressure structure element through which the pressure structure element is mounted to the at least one substantially horizontal or substantially vertical structure element via fastening elements, preferably, the flat bearings serve as the fastening elements, wherein the flat bearing is mounted to the at least one substantially horizontal or substantially vertical structure element in a mounting area in the at least one substantially horizontal or substantially vertical structure element by screwing, welding, gluing, engaging, and more preferably by deforming the flat bearing structure or by dowel portions that are deformed to bear fasten the façade system when inserted to a corresponding portion of the building structure or the pressure structure element, respectively, or by other mounting techniques known in the art.

In another embodiment of the present invention the insulating glass pane unit may comprise at least one inner glass pane, at least one outer glass pane, and at least one support element to keep a predetermined distance between the at least one inner glass pane and at the least one outer glass pane of the insulating transparent pane unit.

A detailed description is given in the following with reference to the accompanying drawings.

BRIEF DESCRIPTION OF THE DRAWINGS

The present invention is more fully understood by reading the subsequent detailed description and examples with reference made to the accompanying drawings, wherein.

DETAILED DESCRIPTION OF THE INVENTION

Figure 1:
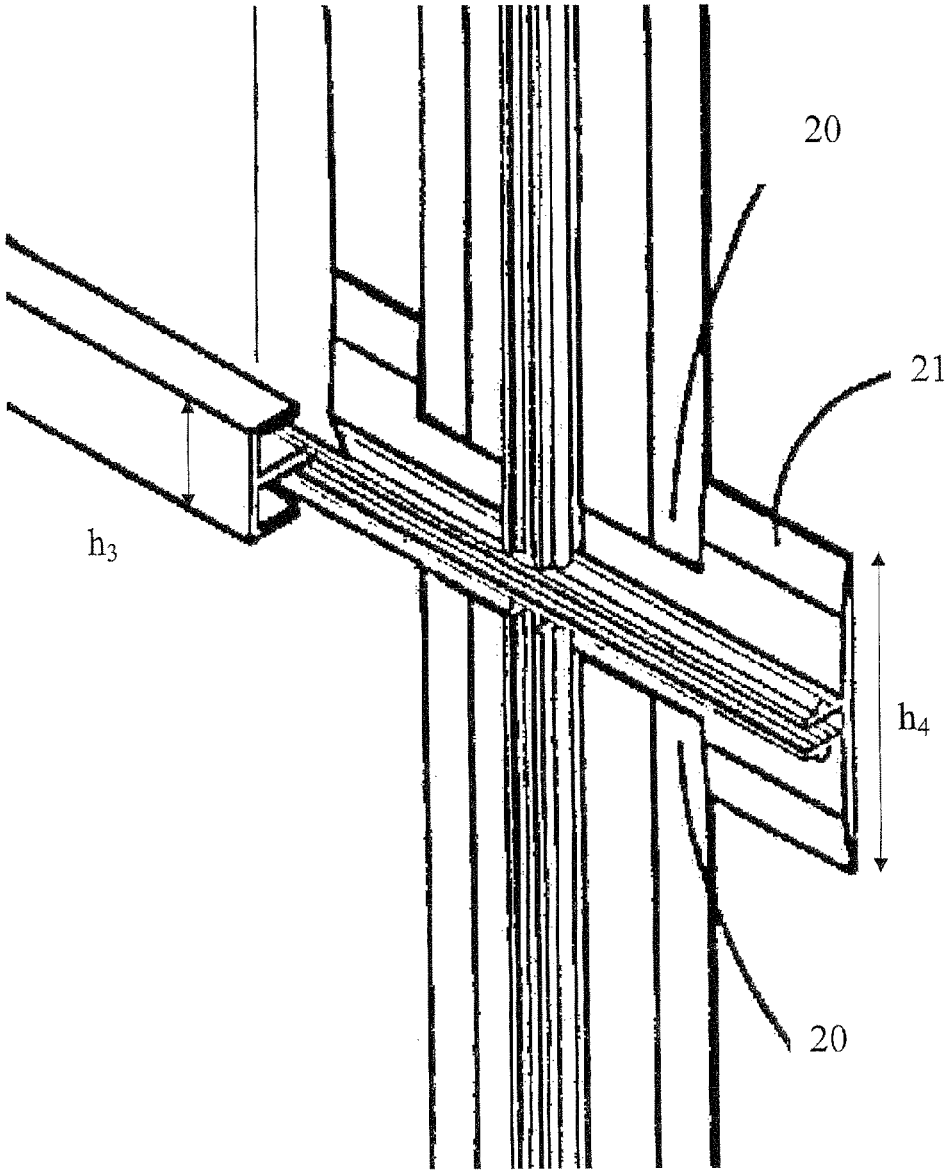
FIG. 1 (Prior Art)
FIG. 1 is a perspective outside view of a state of the art façade system.
Figure 2:
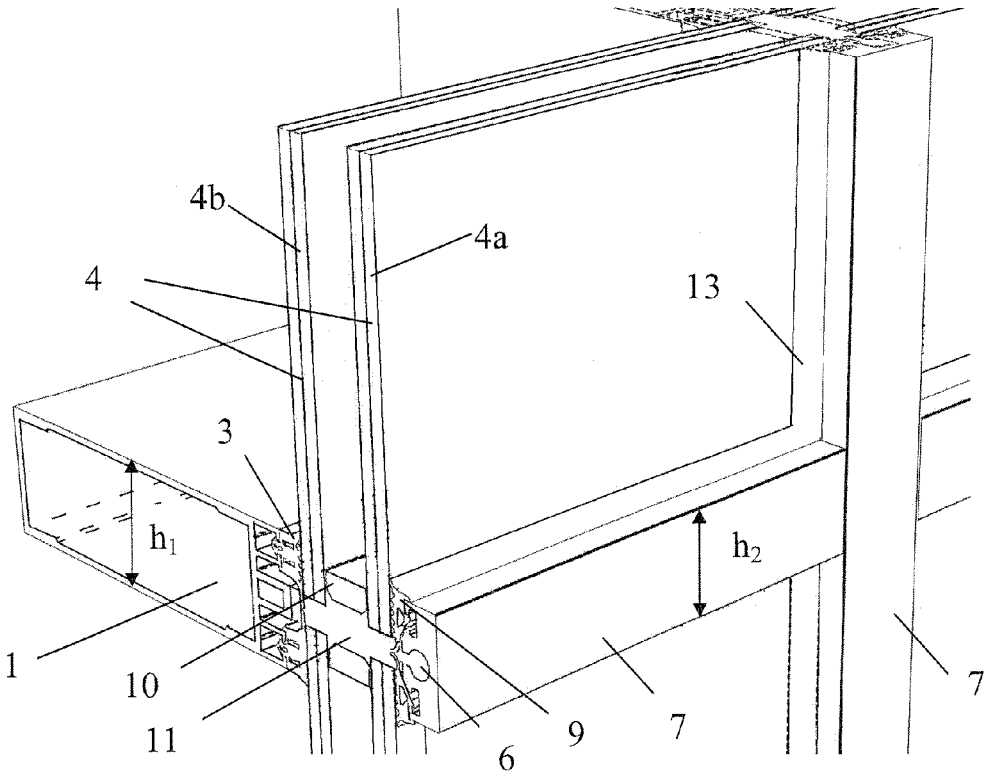
FIG. 2 is a perspective outside view of a façade system according to the present invention.

FIG. 2 is a perspective outside view of a façade system according to the present invention. Referring to FIG. 2, a façade system with less visible supports of the present invention is shown. The façade system comprises at least one substantially horizontal or substantially vertical structure element 1 having a height $h_1$, an inner sealing element 3 mounted on at least one substantially horizontal or substantially vertical structure element 1, a insulating transparent pane unit 4 comprising at least one glass pane, a pressure structure element 7 for pressing the glass panes in the general direction of the at least one substantially horizontal or substantially vertical structure element, wherein the pressure element 7 has a height $h_2$, and an outer sealing element 9 mounted on the pressure structure element 7.

The inventive façade system is characterized in that the height $h_2$ of the pressure element 7 has maximum that is equal to or less than the height $h_1$ of the at least one substantially horizontal or substantially vertical structure element 1 and the façade system further is comprising a flat bearing structure 11 to bear the weight of the insulating transparent pane unit 4 and for pressing the glass panes in the general direction of the at least on substantially horizontal or substantially vertical structure element. Preferably, the height $h_2$ of the at least one substantially horizontal or substantially vertical structure element is equal to or less than 34 mm (1.34 inches). The bearing structures 11 are formed by plates with a thickness of about 0.5 mm (0.02 inches) to 2 mm (0.789 inches), preferably 1 mm (0.4 inches). Said plates may be non-continuous plates to ease transport and mounting of the flat bearing structure. Alternatively, the height $h_2$ of the pressure element 7 has maximum of not more than the height $h_1$ of the at least one substantially horizontal or substantially vertical structure element 1 plus 32 mm (1.26 inches) and the façade system further is compromising a bearing structure 11 to bear the weight of the insulating transparent pane unit 4.

The weight of the used glass pane elements is supported by the preferably flat bearings 11 that may be arranged at any position of the at least one substantially horizontal or substantially vertical structure element. To keep the panes tight on the building, pressure structure elements are mounted from the outside of the building, preferably by the flat bearing structure 11, to fasten the panes tight on the building structure. Additionally, the pressure structure elements 7 press the sealing elements 3, 9 tight on the insulating transparent pane unit, respectively, thereby sealing the façade from meteorological phenomena, like rain, wind and the like. Further, due to the small thickness of the flat bearing structures 11, compared to a conventional securing element like a bolt or a stud, less room is needed to secure the flat bearing structure 11 to the substantially horizontal or substantially vertical structure elements. Therewith, a tighter and flatter building structure can be achieved.

Figure 3:
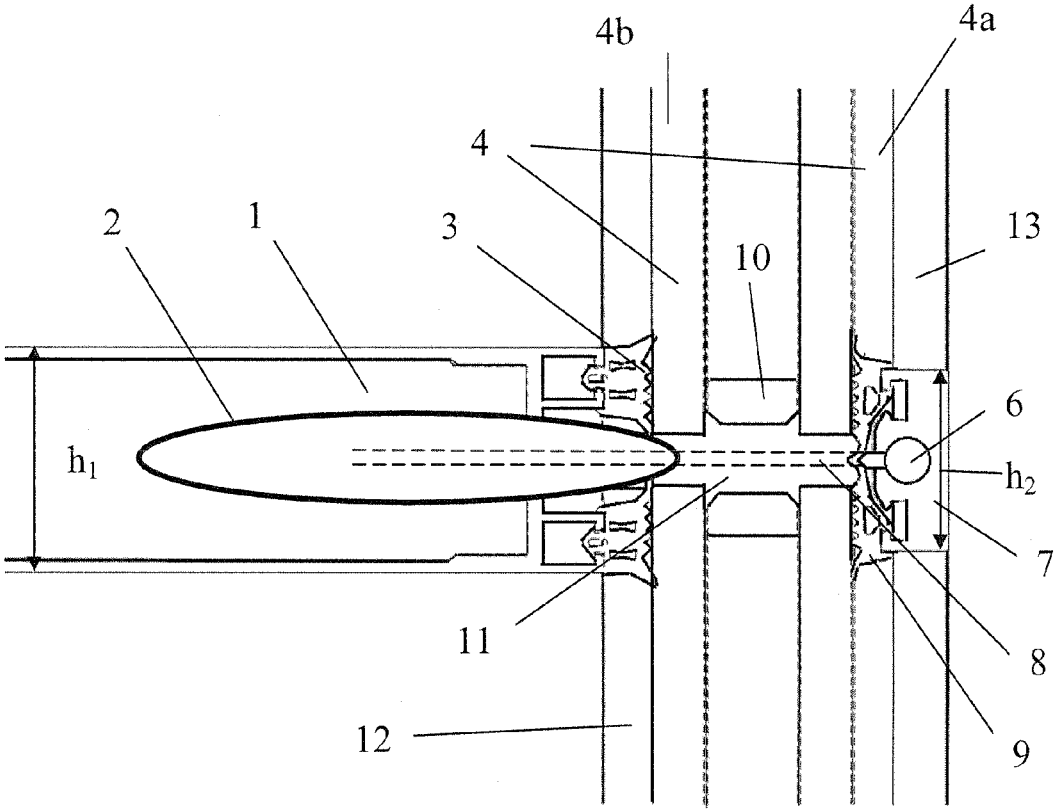
FIG. 3 is a schematic side view of a façade system according to the present invention.

FIG. 3 is a schematic side view of a façade system according to the present invention. Beside the above mentioned elements, FIG. 3 shows the façade system with less visible supports having a groove 6 in the pressure element 7 through which the pressure element 7 is mounted to the at least one substantially horizontal or substantially vertical structure element 1 via a fastening element 8, which is preferably constituted by the flat bearing structure 11. Said mounting may be conducted by welding, using welded studs, screwing, gluding, bending, hammering or deforming the pressure structure element 7 or the flat bearing 11, or other suited mounting methods. The fastening element which is preferably constituted by the flat bearing structure 11 is mounted to the at least one substantially horizontal or substantially vertical structure element 1 in a mounting area 2 in the at least one substantially horizontal or substantially vertical structure element 1 by screwing, welding, gluing, engaging or mounting. This enables a fast and secure mounting of the façade system of the present invention and even a subsequent upgrading of a building with the façade system is possible.

FIG. 3 further shows that the insulating glass pane unit 4 may comprise at least one inner glass pane 4*b*, at least one outer glass pane 4*a*, and at least one support element 10 to keep a predetermined distance between the at least one inner glass pane 4*b* and at the least one outer glass pane 4*a* of the insulating transparent pane unit 4 and therefore, the present invention may save money and energy used for heating in winter and cooling in summer due to the additional insulating space between the inner and outer glass panes 4*b* and 4*a*.

Figure 4:
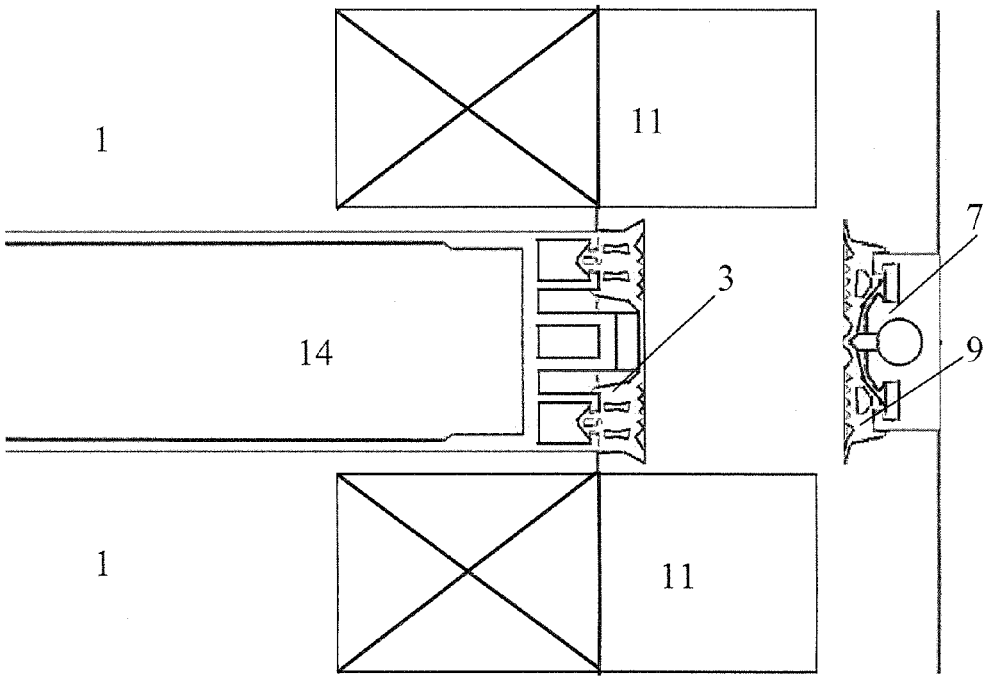
FIG. 4 is a schematic top view of a façade system according to the present invention.

FIG. 4 is a schematic top view of a façade system according to the present invention. Referring to FIG. 4, the preferably flat bearings 11 are shown in detail. The bearings 11 are securely mounted on the at least one substantially horizontal or substantially vertical structure element 1 and may cover parts beside a vertical structure element 14 or may extend steadily through the vertical structure elements 14. Also, instead of extending only at parts of the horizontal structure elements 1 they may align steadily along the whole length of the at least one substantially horizontal or substantially vertical structure element 1, according to the structural needs of the façade and the weight of the used glass panes, respectively.

Figure 5:
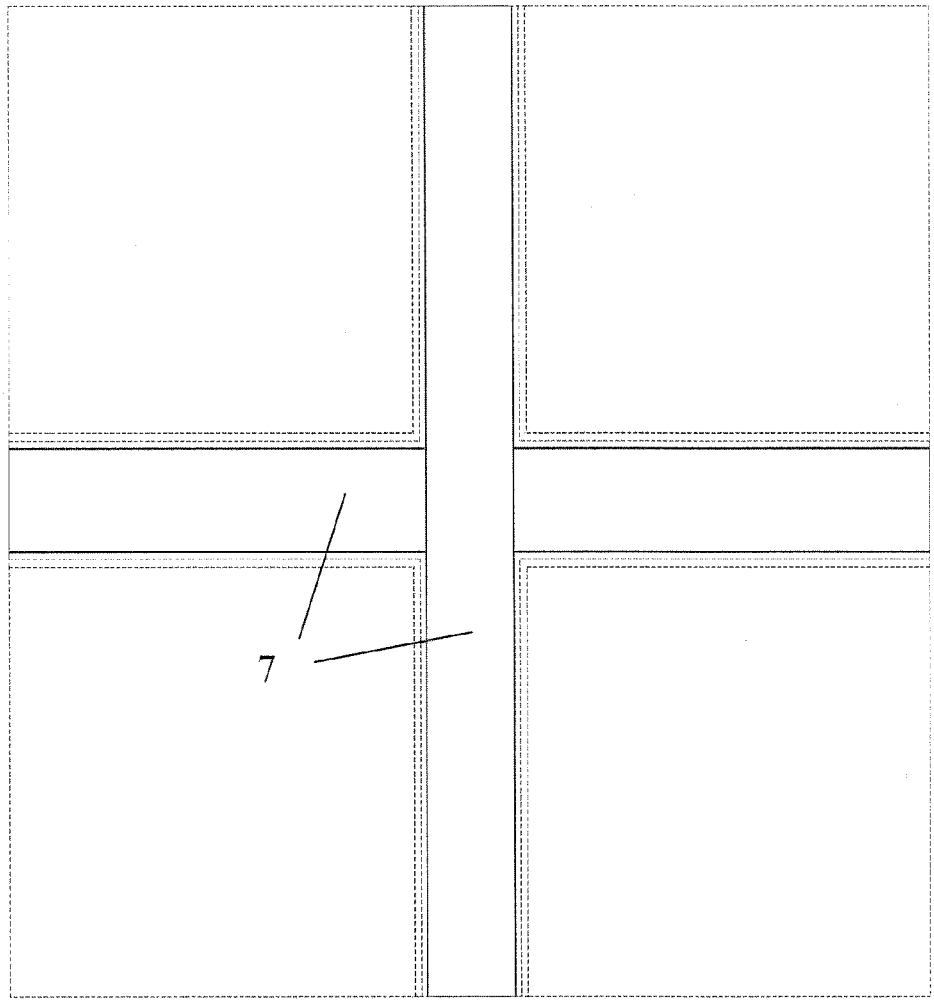
FIG. 5 is a perspective outside view of a façade system according to the present invention.

FIG. 5 is a perspective outside view of a façade system according to the present invention that shows the advantage of the claimed façade system. A human being inside of the building may enjoy an almost undisturbed view on the outside. This allows interesting and fashionable designs and interior decoration possibilities.

While the invention has been described in connection with what is presently considered to be the most practical and preferred embodiment, it is to be understood that the invention is not limited to the disclosed embodiments, but, on the contrary, is intended to accommodate various modifications and equivalent arrangements include within the spirit and the scope of the appended claims.

What claimed is:

1. Facade system with less visible supports, comprising:

at least one substantially horizontal or substantially vertical structure element (1) having a height h1;

an inner sealing element (3) mounted on the at least one substantially horizontal or substantially vertical structure element (1);

an insulating transparent pane unit (4) comprising at least one glass pane;

pressure structure element (7) for pressing the glass panes in the general direction of the at least one substantially horizontal or substantially vertical structure element (1), wherein the pressure structure element (7) has a height h2;

a groove (6) in the pressure element (7) through which the pressure element (7) is screwlessly mounted to the at least one substantially horizontal or substantially vertical structure element (1) via a flat bearing structure (11); and an outer sealing element (9) mounted on the pressure structure element (7), wherein the height h2 of the pressure structure element (7) has maximum that is equal to or less than the height hi of the at least one substantially horizontal or substantially vertical structure element (1), respectively, and wherein the flat bearing structure (11) is mounted in the at least one substantially horizontal or substantially vertical structure element (1) and the pressure structure element (7) is structured and adapted to bear the weight of the transparent isolating pane unit (4) by pressing the glass panes in the general direction of the at least one substantially horizontal or substantially vertical structure element.

2. Façade system with less visible supports of claim 1, wherein the flat bearing structure (11) is mounted to the at least one substantially horizontal or substantially vertical structure element (1) in a mounting area (2) in the at least one substantially horizontal or substantially vertical structure element (1) by welding or gluing, engaging or mounting in addition to said screwless mounting of the pressure element (7) to the at least one substantially horizontal or substantially vertical structure element (1).

3. Façade system with less visible supports of claim 1, further comprising at least one support element (10) to keep a predetermined distance between at least one inner glass pane (4*b*) and at least one outer glass pane (4*a*) of the insulating transparent pane unit (4).

4. Façade system with less visible supports of claim 2, further comprising at least one support element (10) to keep a predetermined distance between at least one inner glass pane (4*b*) and at least one outer glass pane (4*a*) of the insulating transparent pane unit (4).

5. Façade system with less visible supports of claim 1, wherein the height $h_2$ of the at least one substantially horizontal or substantially vertical structure element is equal to or less than 34 mm (1.34 inches).

6. Façade system with less visible supports of claim 1, wherein the thickness of the flat bearing structure (11) is about 0.5 mm (0.02 inches) to 2 mm (0.079 inches), preferably 1 mm (0.04 inches).

7. Façade system with less visible supports, comprising:

at least one substantially horizontal or substantially vertical structure element (1) having a height $h_1$;

an inner sealing element (3) mounted on the at least one substantially horizontal or substantially vertical structure element (1);

an insulating transparent pane unit (4) comprising at least one glass pane;

a pressure structure element (7) for pressing the glass panes in the general direction of the at least one substantially horizontal or substantially vertical structure element (1), wherein the pressure structure element (7) has a height $h_2$;

a groove (6) in the pressure element (7) through which the pressure element (7) is screwlessly mounted to the at least one substantially horizontal or substantially vertical structure element (1) via a flat bearing structure (11); and an outer sealing element (9) mounted on the pressure structure element (7), wherein the height $h_2$ of the pressure structure element (7) has maximum of not more than the height $h_1$ of the at least one substantially horizontal or substantially vertical structure element (1) plus 32 mm (or 1.26 inches), respectively, and wherein the flat bearing structure (11) is structured and adapted to bear the weight of the insulating transparent pane unit (4), the bearing structure (11) being formed by a non-continuous plate and being mounted on the at least one substantially horizontal or substantially vertical structure element (1) and partially extending from portions of the at least one substantially horizontal or substantially vertical structure element (1).

* * * * *